US009443386B2

(12) United States Patent
Seis et al.

(10) Patent No.: US 9,443,386 B2
(45) Date of Patent: Sep. 13, 2016

(54) MONEY DISPENSING UNIT AND GAMING MACHINE HAVING A MONEY DISPENSING UNIT

(71) Applicant: NOVOMATIC AG, Gumpoldskirchen (AT)

(72) Inventors: Berthold Seis, Gutenberg (DE); Marius Rudolph Schuster, Bingen (DE)

(73) Assignee: NOVOMATIC AG, Gumpoldskirchen (AT)

( * ) Notice: Subject to any disclaimer, the term of this patent is extended or adjusted under 35 U.S.C. 154(b) by 15 days.

(21) Appl. No.: 14/443,483

(22) PCT Filed: Nov. 12, 2013

(86) PCT No.: PCT/EP2013/073534

§ 371 (c)(1),
(2) Date: May 18, 2015

(87) PCT Pub. No.: WO2014/076043

PCT Pub. Date: May 22, 2014

(65) Prior Publication Data

US 2015/0332551 A1 Nov. 19, 2015

(30) Foreign Application Priority Data

Nov. 16, 2012 (DE) ..... 10 2012 111 080

(51) Int. Cl.
*G07D 13/00* (2006.01)
*G07F 17/32* (2006.01)
(Continued)

(52) U.S. Cl.
CPC ..... *G07F 17/3244* (2013.01); *G07C 9/00896* (2013.01); *G07F 17/3241* (2013.01); *G07F 17/34* (2013.01)

(58) Field of Classification Search
CPC ..... G07F 1/00; G07F 5/24; G07F 7/04; G07F 1/02; G07D 1/00; G07D 11/0045; G07D 11/0042; G07D 11/0084; G07D 7/02; G07D 9/06
See application file for complete search history.

(56) References Cited

U.S. PATENT DOCUMENTS 3,609,456 A * 9/1971 Kayaguchi ..... H02H 7/08 242/349
3,795,417 A 3/1974 Cohen
(Continued)

FOREIGN PATENT DOCUMENTS

DE 4422296 11/1994
DE 60303986 8/2006
(Continued)

OTHER PUBLICATIONS

International Search Report for PCT/EP2013/073534, English translation attached to original, Both completed by the European Patent Office on Mar. 13, 2014, All together 7 Pages.

*Primary Examiner* — Tramar Harper
*Assistant Examiner* — Jeffrey Wong
(74) *Attorney, Agent, or Firm* — Brooks Kushman P.C.

(57) ABSTRACT

A money dispensing unit, including an electric motor, a control device, which has a storage unit, wherein the electric motor is coupled to the control device of a controllable switch and can be activated with current/voltage of the switch in order to dispense money; and the control device is provided and designed to provide a code. Additionally, a comparison module for receiving the code and comparing the code with a predefined code, wherein if the received code is identical to the predefined code, the switch can be activated in order to supply voltage to the electric motor in order to dispense money is also disclosed.

4 Claims, 2 Drawing Sheets

(51) Int. Cl.
*G07C 9/00* (2006.01)
*G07F 17/34* (2006.01)

(56) References Cited

U.S. PATENT DOCUMENTS 3,798,417 A 3/1974 Bittner
4,250,533 A 2/1981 Nelson
5,010,445 A 4/1991 Weinold
5,380,008 A * 1/1995 Mathis ..... G07F 17/3262 273/143 R
5,530,431 A * 6/1996 Wingard ..... G08B 13/1418 340/12.32
7,145,436 B2 12/2006 Ichikawa et al.
2003/0064806 A1 4/2003 Gordon et al.
2011/0111866 A1 5/2011 Anthony et al.
2013/0036467 A1 2/2013 Krummel et al.

FOREIGN PATENT DOCUMENTS

EP 0004436 10/1979
EP 1400645 3/2006
WO 2011101249 8/2011

* cited by examiner

MONEY DISPENSING UNIT AND GAMING MACHINE HAVING A MONEY DISPENSING UNIT

CROSS-REFERENCE TO RELATED APPLICATION

This application is the U.S. national phase of PCT Application No. PCT/EP2013/073534 filed on Nov. 12, 2013, which claims priority to DE Patent Application No. 10 2012 111 080.8 filed on Nov. 16, 2012, the disclosures of which are incorporated in their entirety by reference herein.

TECHNICAL FIELD

The present invention relates to a gaming machine comprising a game sequence controller, which is connected to a control device of a money dispensing unit, wherein the game sequence controller communicates with the control device for the purpose of dispensing money. Furthermore, the present invention relates to a method for operating a gaming machine comprising a game sequence controller, which is connected to and communicates with a control device of a money dispensing unit for the purpose of dispensing money.

BACKGROUND

The prior art discloses money-operated gaming machines comprising in each case at least one money dispensing unit, in particular for paying out winnings, wherein the money dispensing unit comprises a control device coupled to a game sequence controller, for example. For unauthorized pay-out of money or non-cash objects from the money dispensing unit, a so-called hopper, attempts are made to manipulate the money dispensing unit via an interface, for example, specifically by targeted loading of data which do not originate from the control device, or supply with voltage in order to activate a motor of the money dispensing unit. In order to counteract such manipulations, a multiplicity of measures are implemented, but often they can be realized only very complexly and expensively.

U.S. Pat. No. 5,380,008 A describes a gaming machine comprising a game sequence controller, which is connected to a control device of a money dispensing unit. In this case, the game sequence controller communicates with the control device for the purpose of dispensing money and the money dispensing unit comprises an electric motor, to which voltage can be applied for the purpose of dispensing money.

Furthermore, U.S. Pat. No. 4,250,533 A discloses an electronically encrypted security system. Said system comprises a physical receptacle for a key which is insertable into the receptacle and which comprises a code which is read out contactlessly if the key is situated in the receptacle. Accordingly, an electronically protected mechanical lock is made available.

SUMMARY

The invention is therefore based on the object of providing a gaming machine and a method for operating a gaming machine of the type mentioned in the introduction which have a comparatively high security against unauthorized manipulations of the money dispensing unit, wherein the money dispensing unit is realized with relatively simple means.

According to the invention, this object is achieved by means of the features of the independent claims The dependent claims represent advantageous embodiments of the invention.

A gaming machine comprises a game sequence controller, which is connected to a control device of a money dispensing unit. In this case, the game sequence controller communicates with the control device for the purpose of dispensing money. In this case, the money dispensing unit comprises an electric motor and the control device comprising a storage unit. In this case, the electric motor is coupled to the control device via a controllable switch, which is encapsulated with the electric motor, and is drivable with current/voltage for a specific time via the switch for the purpose of dispensing money. A monostable multivibrator assigned to the switch generates a specific run time of the electric motor by means of a voltage/current supply of corresponding length by virtue of the electric circuit being closed by means of the switch. The control device is provided and designed for outputting a code designed as a voltage sequence with voltage gaps. In this case, a two-core electrical line via which the electric motor is to be supplied with operating voltage/operating current is usable for transmitting the code. Furthermore, the money dispensing unit comprises a comparator component for receiving and comparing the code with a predefined code. A shift register is disposed upstream of the comparator component, wherein the code is filterable by the shift register serially from the voltage present for the electric motor and is forwardable in parallel to the comparator component. In the case where the received code is identical or equal to the known, predefined code, the switch is drivable for the purpose of supplying voltage/current to the electric motor for the purpose of dispensing money via the monostable multivibrator.

The code is for example specifically adapted to the money dispensing unit and is known to the control device and to the comparator component. The code is transmitted in order to ensure that the switch is driven only if the correct code has been transmitted. It is thereby ensured that the information for dispensing money originates from the control device of the money dispensing unit rather than from a manipulation device, wherein the driving of the switch results in supply of voltage/current to the electric motor and therefore dispensing of money. This measure can be realized relatively cost-effectively since, compared with a known money dispensing unit, only minor changes in the construction—such as e.g. merely addition of the comparator component—are required. Furthermore, there is a relatively high security against manipulations from outside, since the transmitted code must be known only to the manufacturer, who coordinates the control device and the comparator component with one another. It goes without saying that the comparator component, the switch and the electric motor can be encapsulated in order that these sensitive components are protected against mechanical manipulation. It is apparent to the person skilled in the art in an obvious way that the switch does not serve directly for supplying voltage/current to the electric motor, but rather is arranged between a voltage/current source and the electric motor in order to interrupt or close an electric circuit.

In the context of the invention, the electric voltage should substantially be equated to the electric current.

The code is formed as a voltage sequence with voltage gaps. The voltage with which the electric motor of the money dispensing unit is operated contains voltage gaps at specific time intervals, wherein these time intervals of the voltage gaps represent a data sequence. Therefore, it is not necessary to provide a special data transmission device. Rather the control device supplies a pulsed voltage which is 0 and 1, for example, in the form of the code and then a voltage which is 1 and corresponds to the operating voltage of the electric motor in order to pay out money, tokens or similar non-cash winnings. Furthermore, the electric motor cannot be activated by simple application of voltage/current or a short circuit in order to dispense the content of a money storage unit from the gaming machine via the assigned money dispensing unit. Modulation of sinusoidal or trapezoidal voltage signals also does not suffice to start the electric motor and therefore to manipulate the money dispensing unit. In this way the unauthorized influencing of the money dispensing unit is made significantly more difficult.

The two-core electrical line via which the electric motor is drivable with operating voltage/operating current is usable for transmitting the code. Accordingly, it is not necessary to change a wiring harness or electrical lines of the money dispensing unit. The invention can therefore be implemented in an existing money dispensing unit without any problems.

A shift register is disposed upstream of the comparator component. The shift register filters the code serially from the voltage for the electric motor and then transfers the code in parallel to the comparator component.

A so-called monostable multivibrator is assigned to the switch. A monostable multivibrator is an electronic or electromechanical circuit which has only one stable state. In a manner driven by an external pulse or trigger pulse, a switching state of the monostable multivibrator is changed for a specific time duration until the monostable multivibrator returns to a quiescent position (stable state). The specific time duration is determined by a dimensioning of the monostable multivibrator. In the case of the substantive invention, the trigger pulse is initiated by the comparator component. As a result, the triggered monostable multivibrator generates a fixedly set run time of the electric motor. If the code is sent by the control device only once, for example, then the monostable multivibrator switches off the electric motor after a minimum run time. The monostable multivibrator is retriggerable, however, as a result of which the electric motor can be switched on without interruption.

In order to enable simple adaptation when components are exchanged, expediently the comparator component is assigned a coding switch, in particular a DIP switch, or a memory for the predefined code. The comparator component can then be adapted to the code of the control device by means of a corresponding manual setting of the DIP switch.

The indicated object is furthermore achieved by means of a method for operating a gaming machine comprising a game sequence controller, wherein the game sequence controller is connected to and communicates with a control device of a money dispensing unit for the purpose of dispensing money. In this case, the money dispensing unit comprises an electric motor and a control device comprising a storage unit. In this case, the electric motor is coupled to the control device via a controllable switch, which is encapsulated with the electric motor, and the electric motor is driven with current/voltage for a specific time via the switch for the purpose of dispensing money. In this case, a monostable multivibrator assigned to the switch generates a specific run time of the electric motor by means of voltage/current supply of corresponding length by virtue of the electric circuit being closed by means of the switch. In this case, the control device is provided and designed for outputting a code formed as a voltage sequence with voltage gaps. A two-core electrical line via which the electric motor is supplied with operating voltage/operating current is used for transmitting the code. Furthermore, in the case of the money dispensing unit, a comparator component for receiving and for comparing the code with a predefined code is provided, and in this case a shift register is disposed upstream of the comparator component. The code is filtered by the shift register serially from the voltage present for the electric motor and is then forwarded in parallel to the comparator component. In the case where the received code is identical or corresponds to the known, predefined code, the switch is driven for the purpose of supplying voltage to the electric motor for the purpose of dispensing money via the monostable multivibrator.

The control device comprises for example the storage component or the like in order to store the code which is sent to the comparator component. In order to provide a comparatively high security against unauthorized manipulation, each money dispensing unit can be assigned an individual code. It is also possible to assign a common code to a specific series of money dispensing units.

The code is filtered serially from the voltage serving as an operating voltage for the electric motor and is forwarded in parallel to the comparator component by the shift register. In the case where the received code corresponds to the known code, that is to say the predefined code, the monostable multivibrator and therefore the switch, by means of which the electric motor is supplied with the operating voltage/operating current for a specific time, are addressed by the comparator component.

The code is input by means of a code input unit at the comparator component. The code input unit can for example be integrated into an electronic service device or, as already explained, be embodied as a DIP switch at the comparator component.

The above-explained money dispensing unit can be integrated in a simple manner into arbitrary devices in which money processing or a pay-out of money or non-cash objects takes place. The money dispensing unit is preferably used in a gaming machine, but such a restriction is not mandatory; rather, the money dispensing unit can also be provided in a money changer, a goods vending machine or a so-called cash dispenser, without this being an exhaustive enumeration.

If a money return switch of the gaming machine is actuated, for example, corresponding signaling to the game sequence controller is effected. In this case the game sequence controller in turn drives the control device of the money dispensing unit in order to activate the electric motor for dispensing money. In this case, with the voltage the code comprising voltage signals is sent to the comparator component of the money dispensing unit, which comparator component compares the received code with a known, predefined code and, in the case where the received code is identical or corresponds to the predefined code, drives the switch via the monostable multivibrator for the purpose of closing an electric circuit for the purpose of supplying voltage or current to the electric motor.

It goes without saying that the features mentioned above and those yet to be explained below can be used not only in the combination respectively indicated, but also in other combinations. The scope of the invention is defined only by the claims.

BRIEF DESCRIPTION OF THE DRAWINGS

The invention is explained in greater detail below on the basis of an exemplary embodiment with reference to the associated drawing, in which.

DETAILED DESCRIPTION

Figure 1:
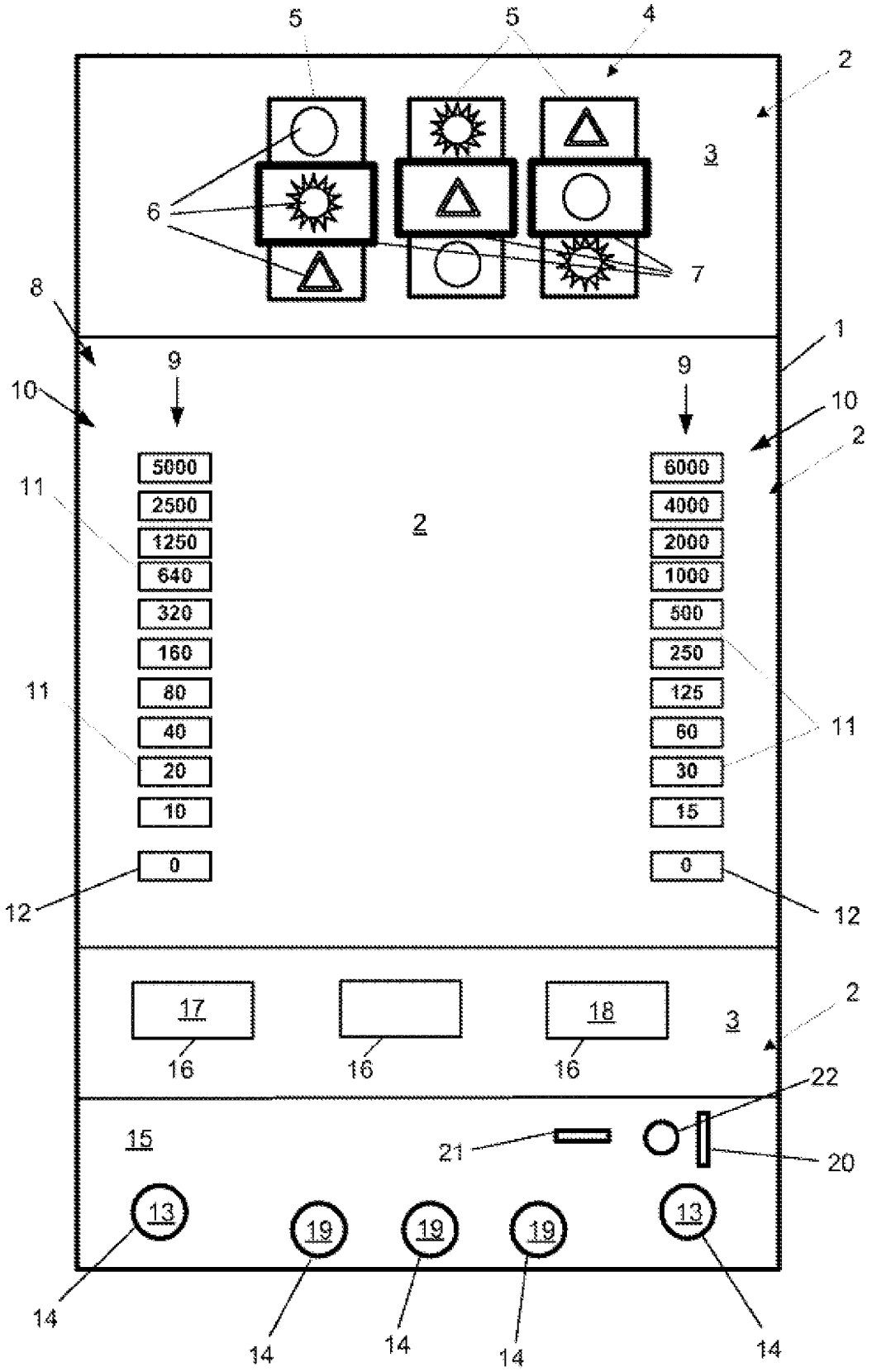
FIG. 1 shows a schematic illustration of a front view of a gaming machine comprising a money dispensing unit according to the invention.
Figure 2:
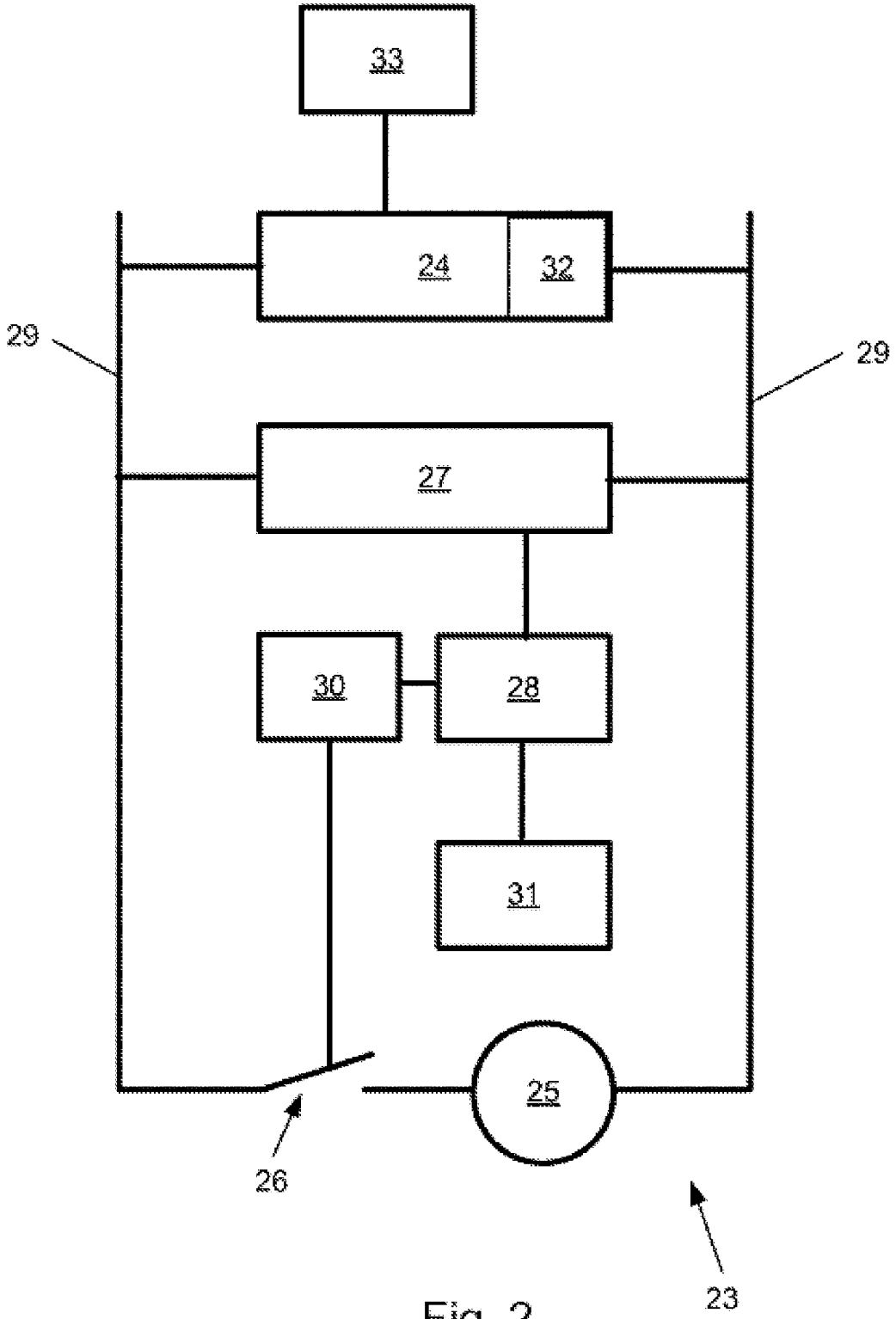
FIG. 2 shows a schematic partial illustration of the money dispensing unit for the gaming machine according to FIG. 1.

The front of the housing 1 of the money-operated, computer-controlled gaming machine with a win opportunity has three display devices 2 in the form of screens 3 arranged one above another, the top screen 3 of which is used to present a gaming device 4. The gaming device 4 is visually presented in the form of a symbol gaming device with three revolving bodies 5 in cylindrical form that are arranged next to one another. In a computer-controlled manner, a game sequence controller 33 generates an image corresponding to rotating revolving bodies 5 with circumferential symbols 6. Furthermore, in a computer-controlled manner, reading windows 7 are presented on the screen 3, which are used to display a randomly controlled game result, that is to say a specific combination of symbols 6. The presentation of the game result is accompanied by a display of the virtual revolving bodies 5 that corresponds to stopped cylinders. From the displayed symbols 6, the user can read off the game result, in particular also whether there is a win according to a displayable win plan.

The screen 3 in the middle of the gaming machine is embodied as a touchscreen 8 and is used to present supplementary gaming devices 10 embodied as risk ladders 9. The winnings attained in the gaming device 4 by achieving a symbol combination determined in a randomly controlled manner can be transferred under key or computer control as a stake to one of the supplementary gaming devices 10 arranged on both sides of the central screen 3. The left-hand risk ladder 9 comprises a plurality of display panels 11 presented one above another, which are allocated winnings values from 10 to 5000 points in ascending order. The right-hand risk ladder 9 likewise has a plurality of display panels 11 presented one above another, which are allocated winnings values from 15 to 6000 points in ascending order.

The winnings displayed in the risk ladder 9 are gambled by virtue of the fact that the next higher display panel 11 in relation to the visually highlighted display panel 11 that displays the winnings is presented so as to flash alternately with a total loss display panel 12 labeled "0" that is placed below the risk ladder 9. When a key 13 embodied as a pushbutton key is actuated, the momentary contact switch 14 of said key being arranged in a lower housing section 15, either the next higher winnings are attained or the staked winnings are lost, under random control. This process can be continued until the presented maximum winnings in terms of points are reached.

The bottom screen 3 is provided with displays 16 for credits, points, winnings and the like, with one of the displays 16 representing a points bank 17. When there is a credit in a display 16 embodied as a credit display 18, a specific sum of money from the credit display 18 is converted into a specific number of points and added to the points bank 17, from which a specific number of points are debited as a stake for a game in the gaming device 4 and to which points won in the gaming device 4 are added. When a cash value is paid out, the points value in the points bank 17 is first of all converted into a credit in a prescribed time interval, which credit is to be presented in the credit display 18.

Restart/stop keys embodied as pushbutton keys 19 with corresponding momentary contact switches 14 are arranged in the lower housing section 15 of the gaming machine, and when said keys are acted on, that symbol 6 of the assigned revolving body 5 which is displayed in the gaming device 4 can be restarted or prematurely stopped. That is to say, the display is influenced in such a way that the revolving bodies 5 appear in a stationary or rotating form. It goes without saying that all of the momentary contact switches 14 can be backlit, preferably in color, in particular depending on the progression of the game. Furthermore, a coin insertion slot 20 and a banknote feed slot 21 of a money processing device (not illustrated in more specific detail) are provided. Moreover, a return key 22 is arranged next to the coin insertion slot 20, and actuation of said return key enables a credit displayed in the credit display 18 to be withdrawn to a dispensing tray (not illustrated), wherein a momentary contact switch 14 is likewise assigned to the return key 22.

The money processing device of the gaming machine comprises a money dispensing unit 23, comprising a control device 24 connected to the game sequence controller 33 of the gaming machine. Furthermore, the money dispensing unit 23 comprises an electric motor 25, which is to be supplied with current/voltage for the purpose of dispensing money, wherein the current/voltage is released by the control device 24 for a specific time by means of the actuation of an electronic, controllable switch 26 disposed upstream. In order to prevent a manipulation of the pay-out process by illegitimate supply of voltage/current to the electric motor 25, a comparator component 28 is provided or disposed upstream for controlling the switch 26 of the electric motor 25. A code, which is stored in a storage unit 32 of the control device 24, is sent to the comparator component 28 by the control device 24 via a two-core electrical line 29. This code, which is filtered by means of a shift register 27, is compared with a code which is known to the comparator component 28 using said comparator component 28. In the case where the received code is identical or corresponds to the known or predefined code, the switch 26 is driven for the purpose of supplying voltage/current to the electric motor 25 for the purpose of dispensing money via a monostable multivibrator 30.

The code sent to the comparator component 28 by the control device 24 is present in the form of gaps in the voltage that supplies the electric motor 25, wherein the voltage gaps represent a data sequence. This data sequence firstly must be generated correctly and subsequently must also be identified as correct by the comparator component 28 in order that the switch 26 encapsulated with the electric motor 25 is closed in order to supply the electric motor 25 with the voltage required for paying out money or non-cash objects.

The code which is communicated by the control device 24 in a so-called pulse packet and which can also be set by means of a DIP switch 31 at the comparator component 28 is filtered by the shift register 27 serially from the voltage present for the electric motor 25 and is forwarded in parallel to the comparator component 28. The comparator component 28 compares the code which has been set or predefined by means of DIP switch 31 with the preset code received from the control device 24 via the shift register 27. In the event of a correspondence, the comparator component 28 then initiates a pulse for as short a time as desired. The monostable multivibrator 30 driven with the pulse subsequently generates a specific run time of the electric motor 25 by means of a voltage/current supply of corresponding length by virtue of the electric circuit being closed by means of the switch 26. If the code is sent by the control device 24 only once, then the monostable multivibrator 30 interrupts the voltage/current supply by opening the switch 26 and accordingly switches off the electric motor 25 after a minimum run time. Since the monostable multivibrator 30 is embodied in a retriggerable fashion, the switch 26 disposed upstream of the electric motor 25 can be switched on without interruption.

In one possible implementation of the circuit, the code, that is to say the logic signal, is tapped off and voltage/current for supplying the electric motor 25 is generated. In this case, it is possible to accept the voltage gaps, that is to say 0V levels, having a duration of less than 1.5 ms as a 0 and having a duration of greater than 1.5 ms as a 1 into the shift register 27. In the time in which the shift register 27 has to be filled, it is necessary to send the 0V levels within less than 3.5 ms, for example. If a greater level, that is to say a so-called high level, is sent or received for longer than 3.5 ms, then the content of the shift register 27 is compared with the code set by way of the DIP switch 31 by means of the comparator component 28 and, in the event of a correspondence between the content of the shift register 27 and the predefined code, the switch 26 embodied as a MOS-FET is turned on in order to supply the electric motor 25 with voltage/current.

REFERENCE SIGNS

1. Housing
2. Display device
3. Screen
4. Gaming device
5. Revolving body
6. Symbol
7. Reading window
8. Touchscreen
9. Risk ladder
10. Supplementary gaming device
11. Display panel
12. Total loss display panel
13. Key
14. Momentary contact switch
15. Housing section
16. Display
17. Points bank
18. Credit display
19. Pushbutton key
20. Coin insertion slot
21. Banknote feed slot
22. Return key
23. Money dispensing unit
24. Control device
25. Electric motor
26. Switch
27. Shift register
28. Comparator component
29. Line
30. Monostable multivibrator
31. DIP switch
32. Storage unit
33. Game sequence controller

The invention claimed is:

1. A gaming machine comprising a game sequence controller, which game sequence controller is connected to a control device of a money dispensing unit, wherein the game sequence controller communicates with the control device for the purpose of dispensing money, wherein the money dispensing unit comprises;

an electric motor and the control device comprising a storage unit, wherein the electric motor is coupled to the control device via a controllable switch, which is encapsulated with the electric motor, and is drivable with current/voltage for a specific time via the switch for the purpose of dispensing money, wherein a monostable multivibrator assigned to the switch generates a specific run time of the electric motor by a voltage/current supply of corresponding length by virtue of the electric circuit being closed by the switch; and wherein the control device is provided and designed for outputting a code formed as a voltage sequence with voltage gaps; and wherein a two-core electrical line via which the electric motor is to be supplied with operating voltage/operating current is usable for transmitting the code, a comparator component for receiving the code and comparing the code with a predefined code, wherein a shift register is disposed upstream of the comparator component, wherein the code is filterable by the shift register serially from the voltage present for the electric motor and is forwardable in parallel to the comparator component, and in the case where the received code is identical to the predefined code, the switch is drivable for the purpose of supplying voltage to the electric motor for the purpose of dispensing money via the monostable multivibrator.

2. The gaming machine as claimed in claim 1, wherein the comparator component is assigned a coding switch, in particular a DIP switch, or a memory for the predefined code.

3. A method for operating a gaming machine comprising a game sequence controller, which game sequence controller is connected to and communicates with a control device of a money dispensing unit for the purpose of dispensing money, wherein the money dispensing unit comprises an electric motor and the control device comprising a storage unit, wherein the electric motor is coupled to the control device via a controllable switch, which is encapsulated with the electric motor, and is driven with current/voltage for a specific time via the switch for the purpose of dispensing money, wherein a monostable multivibrator assigned to the switch generates a specific run time of the electric motor by a voltage/current supply of corresponding length by virtue of the electric circuit being closed by the switch; and wherein the control device is provided and designed for outputting a code formed as a voltage sequence with voltage gaps; and wherein a two-core electrical line via which the electric motor is supplied with operating voltage/operating current is used for transmitting the code, a comparator component for receiving the code and comparing the code with a predefined code, wherein a shift register is disposed upstream of the comparator component, wherein the code is filtered by the shift register serially from the voltage present for the electric motor and is forwarded in parallel to the comparator component, and in the case where the received code is identical to the predefined code, the switch is driven for the purpose of supplying voltage to the electric motor for the purpose of dispensing money via the monostable multivibrator.

4. The method as claimed in claim 3, wherein the code is input by means of a code input unit at the comparator component.

* * * * *